US005394181A

United States Patent [19]

Braun

[11] Patent Number: 5,394,181

[45] Date of Patent: Feb. 28, 1995

[54] AIR BUBBLE REMOVAL IN A DROP ON DEMAND INK JET PRINT HEAD

[75] Inventor: Hilarion Braun, Beaver Creek, Ohio

[73] Assignee: Eastman Kodak Company, Rochester, N.Y.

[21] Appl. No.: 921,874

[22] Filed: Jul. 29, 1992

[51] Int. Cl.[6] ..... B41J 2/19

[52] U.S. Cl. ..... 347/92; 347/93; 347/40

[58] Field of Search ..... 346/140 R; 347/40, 92, 347/93

[56] References Cited

U.S. PATENT DOCUMENTS 4,149,172 4/1979 Heinzl et al. ..... 346/140 R
4,323,908 4/1982 Lee et al. ..... 346/140 R
4,466,005 8/1984 Yoshimura ..... 346/140
4,536,777 8/1985 Matusmoto et al. ..... 346/140 R

FOREIGN PATENT DOCUMENTS

0422870A2 8/1990 European Pat. Off. .

*Primary Examiner*—Joseph W. Hartary
*Assistant Examiner*—Valerie Lund
*Attorney, Agent, or Firm*—Milton S. Sales

[57] ABSTRACT

A drop on demand ink jet print head includes air bubble removal channels having a larger cross sectional area than the ink jet printing channels. In operation, the air bubble removal channels are operated to remove air bubbles from an ink manifold prior to ink jet printing.

6 Claims, 1 Drawing Sheet

AIR BUBBLE REMOVAL IN A DROP ON DEMAND INK JET PRINT HEAD

FIELD OF THE INVENTION

The present invention relates to drop on demand ink jet printing systems, and more particularly to structure for removing air bubbles in the print heads of such ink jet printing systems.

BACKGROUND OF THE INVENTION

European Patent Application No. 0 422 870 A2 discloses a drop on demand ink jet printing apparatus that includes a piezoelectric substrate defining an array of parallel uniformly spaced channels provided with respective droplet ejection nozzles, an ink supply common to the channels, and electrically actuable means for applying pulses of energy to ink in the channels to effect droplet ejection from the channels. The length of the channels is chosen to provide a high longitudinal resonant frequency, and the pulses of energy are applied at or near the resonant frequency of the channels to effect droplet ejection. The channel densities in such print heads can be from 2 to 16 per millimeter.

At such high channel densities, bubbles which form in the ink may block the entrance to a channel, thereby preventing operation of the ink jet.

U.S. Pat. No. 4,466,005 discusses the problem of removing air bubbles from a drop on demand ink jet print head and solves the problem by applying a plurality of drive signals of different pre-selected voltages and frequencies in predetermined cycles to remove air bubbles from the print head. This approach is not effective however when the air bubbles are too large and the surface tension of the ink prevents the air bubbles from entering the ends of the channels in the high density print heads of the type disclosed in EP 0 422 870 A2.

SUMMARY OF THE INVENTION

It is an object of the present invention to solve the problem noted above with respect to removal of bubbles in a print head of the type disclosed in EP 0 422 870 A2. The object is achieved according to the present invention by an ink jet print head having an ink jet printing channel with a first cross sectional area and a bubble exhaust channel with a second cross sectional area larger than the first cross sectional area, and an ink manifold in fluid communication with both the ink jet printing channel and the bubble exhaust channel. In operation, the bubble exhaust channel is actuated to remove bubbles from the ink manifold prior to operating the ink jet printing channel.

MODES OF CARRYING OUT THE INVENTION

Figure 1:
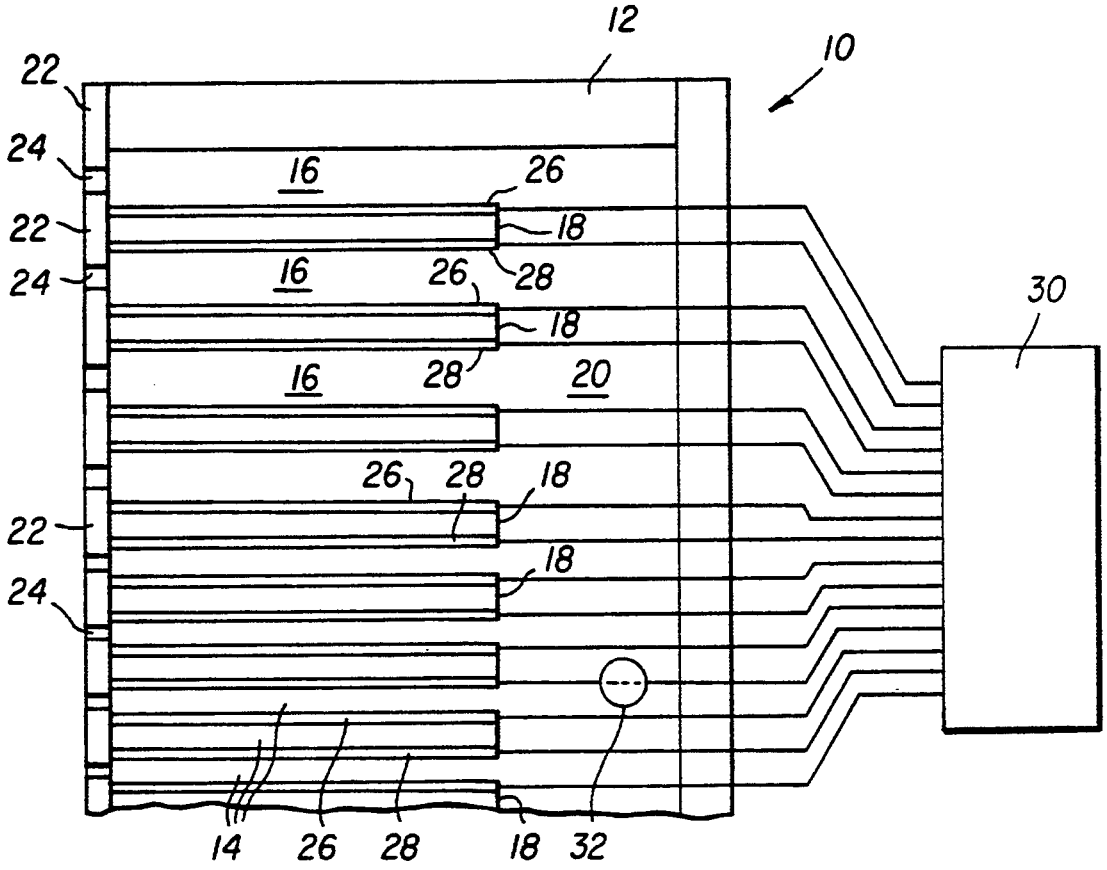
FIG. 1 is a partial cross sectional side view of an ink jet print head having a bubble exhaust channel according to the present invention.

Referring now to FIG. 1, there is illustrated a drop on demand ink jet print head 10 generally of the type shown in European published application 0 422 870 A2, filed Aug. 10, 1990 by Paton. The print head 10 includes a body 12 of poled piezoelectric material that defines one or more printing channels 14 and one or more bubble exhaust channels 16. The channels 14 and 16 are defined within body 12 by walls 18 which separate the channels. One end of each of the channels 14 and 16 is in fluid communication with an ink manifold 20 that is connected to a supply of ink, not shown. The other ends of the channels are covered by a nozzle plate 22 that defines a nozzle 24 for each channel from which drops of ink may be ejected. Electrodes 26 and 28 are located on the internal walls 18. Control electronics 30 supplies voltage to the electrodes to cause the walls to deflect in a shear mode thereby rapidly changing the pressure within a channel and causing a drop of ink to be ejected from the nozzle 22. Since the walls are deflected in pairs toward each other, the channels are actuated in alternate interleaved groups.

According to the present invention, the bubble exhaust channels 16 have a larger cross sectional area than the printing channels 14. Because of their larger cross sectional area, the bubble exhaust channels are actuated more easily, i.e. they have less drag per volume of ink, and admit air bubbles more readily. For example, the bubble 32 shown in FIG. 1 would block the end of one of the printing channels 14 and could be trapped there due to surface tension, thereby inactivating the printing channel. In contrast, the bubble 32 can easily enter one of the larger bubble exhaust channels 16 and be expelled therefrom by actuating the channel. In a preferred arrangement, the print head 10 is oriented with the bubble exhaust channel 16 at the top of the print head, so that the air bubbles trapped in the manifold 20 are assisted in their rise to the top by gravity.

Figure 2:
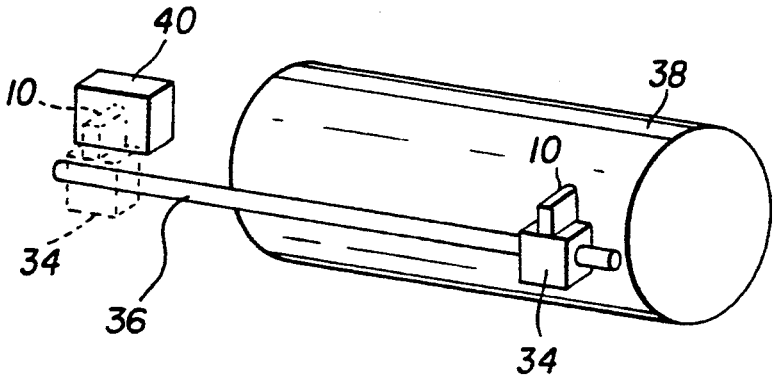
FIG. 2 is a schematic diagram illustrating the ink jet print head shown in FIG. 1 in an ink jet printer having a home station.

FIG. 2 is a schematic diagram of an ink jet printer having a print head according to the present invention. The printer includes the print head 10 mounted on a carriage 34 for movement back and forth on a guide 36 along a print drum 38. A home station 40 is provided at one side of the print drum 38. The home station 40 is provided with means such as a piece of blotter paper for receiving and containing ink ejected from the print head 10 while the print head is located in front of the home station, as illustrated in phantom in FIG. 2.

In operation, the ink jet print head 10 is periodically positioned in front of the home station 40 and the bubble exhaust channels 16 are actuated to expel any air bubbles that may have entered the manifold 20. In a preferred arrangement, the bubble exhaust channels 16 include two active channels that are actuated at their fundamental resonant frequency, and at a high amplitude, surrounded by two passive channels that are not driven. The active channels are driven to the point where the passive channels just begin to eject ink, thereby preventing air from being pumped into the printing channels 14. A volume of ink equal or greater than the volume of ink contained in the manifold is ejected along with air bubbles.

After the bubble purge cycle, the print head is moved across the drum 38 and the printing channels 16 are actuated in the known manner to print on a media supported by the print drum.

In a preferred embodiment, the printing channels 14 are 0.3 centimeters long and have a generally rectangular cross section of 0.05 millimeters $\times$0.15 millimeters. The walls 18 are 0.05 millimeters thick, yielding a spacing of printing jets of 100 jets per centimeter. The bubble exhaust channels are 0.3 centimeters long and have a rectangular cross section of 0.15 millimeters$\times$0.15 millimeters.

I claim:

1. A drop on demand ink jet printing apparatus adapted to emit ink, comprising:

a. an ink jet print channel through which ink may flow in a predetermined direction, said ink jet print channel having a first cross sectional area in a plane normal to the predetermined direction of ink flow;

b. a bubble exhaust channel through which ink may flow and air bubbles may pass in an exhaust direction, said bubble exhaust channel having a second cross sectional area in a plane normal to the exhaust direction of ink flow which is larger than said first cross sectional area; and c. an ink manifold in fluid communication with said ink jet print channel and said bubble exhaust channel, said channels exhibit respective resonant frequencies;

d. means for actuating said ink jet print channel at the resonant frequency of said ink jet print channel to eject ink drops therefrom for printing; and e. means for actuating said bubble exhaust channel at the resonant frequency of said bubble exhaust channel to purge bubbles from said ink manifold.

2. The apparatus claimed in claim 1, wherein said ink jet print channel is one of an array of parallel uniformly spaced print channels.

3. The apparatus claimed in claim 2, wherein said array of print channels is arranged to form a vertical stack, and said bubble exhaust channel is located at atop of said stack.

4. The apparatus claimed in claim 2, wherein said bubble exhaust channel is one of a plurality of active bubble exhaust channels located adjacent said array of print channels.

5. The apparatus claimed in claim 4, further comprising a passive bubble exhaust channel located between said array and said active bubble exhaust channels.

6. A method of removing bubbles in a drop on demand ink jet printing apparatus adapted to emit ink and having (i) an ink jet print channel through which ink may flow in a predetermined direction, the ink jet print channel having a first cross sectional area in a plane normal to the predetermined direction of ink flow, (ii) a bubble exhaust channel through which ink may flow and air bubbles may pass in an exhaust direction, the bubble exhaust channel having a second cross sectional area in a plane normal to the exhaust direction of ink flow which is larger than the first cross sectional area, (iii) an ink manifold in fluid communication with the ink jet printing channel and the bubble exhaust channel, and (iv) a home station, said method comprising the steps of:

a. positioning said bubble exhaust channel at the home station; and b. changing the pressure within the bubble exhaust channel to eject ink drops therefrom to dispel bubbles from said ink manifold.

* * * * *